United States Patent [19]

Gieske, Jr.

[11] 4,075,817

[45] Feb. 28, 1978

[54] APPARATUS FOR BALING COMPRESSIBLE MATERIAL

[76] Inventor: Edward T. Gieske, Jr., Chattolanee Hill, Owings Mills, Md. 21117

[21] Appl. No.: 676,675

[22] Filed: Apr. 14, 1976

[51] Int. Cl.[2] ..... B65B 13/20; B65B 63/02

[52] U.S. Cl. ..... 53/124 A; 53/124 D; 53/124 TS; 100/215; 100/218

[58] Field of Search ..... 53/124 A, 124 C, 124 D, 53/124 TS; 100/215, 218, 295

[56] References Cited

U.S. PATENT DOCUMENTS

| | | | |
|---|---|---|---|
| 2,869,296 | 1/1959 | Overman | 53/124 D X |
| 3,455,141 | 7/1969 | Bracco et al. | 100/DIG. 18 |
| 3,511,019 | 5/1970 | Neitzel et al. | 53/124 TS X |
| 3,641,734 | 2/1972 | Fishburne | 53/124 D X |
| 3,824,758 | 7/1974 | Hart et al. | 53/124 A X |

*Primary Examiner*—Travis S. McGehee
*Attorney, Agent, or Firm*—Cushman, Darby & Cushman

[57] ABSTRACT

Apparatus is provided for baling compressible material between a pair of bale boards. The material is supplied to a retractable chamber and onto a bale board positioned at the bottom of the chamber when the chamber is in the down position. A ram is movable within the chamber to compress the material onto the board. Following partial withdrawal of the ram to permit a bale board to be inserted within the chamber, the ram descends to form the bale to its final dimensions. Upon retraction of the chamber, an ejector moves laterally to the direction of ram movement to displace the bale to a station where straps are secured about the bale. The ram returns to its up position and after return of the ejector to its original position, the chamber is moved to its down position in readiness for the fabrication of the next bale. The underside of the ram and the support for the underside of the bottom bale board are provided with low frictional resistance arrangements to facilitate the displacement of a bale to the strapping station.

9 Claims, 8 Drawing Figures

18
18
16
52
14
12
47
50
28
46
44
30
24
10
50
42
28
12
48
38
12
34
40

APPARATUS FOR BALING COMPRESSIBLE MATERIAL

BACKGROUND OF THE INVENTION

The present invention relates to apparatus for baling compressible material such as tobbacco and is an improvement over balers of the type disclosed in U.S. Pat. No. 3,824,758 which was granted on July 23, 1974 in the names of Joel C. Hart and Charles W. Traughler, Jr. In the operation of such apparatus, the material to be baled is introduced into an enclosed charging chamber having a board at its bottom. A ram moves within the chamber to compress the material onto the board. The ram then is partially withdrawn to allow a top board to be inserted within the chamber to cover the compressed material. The ram next is moved to engage the top board and the chamber is retracted so as to expose the bale formed by the boards and the compressed material. The bale thereafter is moved laterally out of the path of the chamber and the ram to a station where suitable straps or the like are secured about the bale to hold it intact.

According to the disclosure of U.S. Pat. No. 3,824,758, after the top bale board is inserted within the chamber, the ram recompresses the bale to a thickness less than its final size. The ram then is removed from contact with the top board to relieve pressure on the bale, and during expansion of the bale, it is moved laterally by an ejector between two sets of powered rollers which convey the bale to the strapping station, making as many stops as straps are to be applied. However, such a procedure introduces a serious problem since the compressed material often expands non-uniformly so as to distort the bale shape. Such distortion can adversely affect the ejection operation, causing the bale to be ruined. Furthermore, the system requires additional motors to drive the powered rollers which must be precisely controlled to stop at each strapping position.

An important object of the present invention is to provide an arrangement whereby the bale is positively held at its proper size by the ram during the ejection step. If this were to be done with the apparatus of Patent 3,824,758, the ejector would be required to exert considerable force on the bale in order to overcome the substantial frictional resistance between the bale boards and the surfaces which the boards contact. With the present invention, an arrangement is provided whereby the formed bale is ejected with relatively low force being applied to the bale by the ejector.

Additionally, it is a further object of the invention to provide means for reducing the likelihood of accidental contact between the ram and the ejector. However, by employing an ejector operating with low force, even if such contact should occur, the likelihood of extensive damage is substantially reduced.

The present invention operates with fewer cyclic movements of the ram than is required by the arrangement described in U.S. Pat. No. 3,824,758. As a result, the control system utilized is simpler than that required to practice the invention disclosed in Patent 3,824,758. Consequently, the likelihood of an accident due to cyclic abnormality is reduced.

SUMMARY OF THE INVENTION

Briefly, the invention comprises a ram head having ribs in its bale board-engaging surface extending in the direction of lateral movement of the bale. A roller system cooperates with the charging chamber whereby when the latter is withdrawn to expose the bale for ejection, the roller system is elevated to engage the support the bottom bale board. Consequently, the ejector ram operates with low force to move the bale laterally from the loading position. The orientation of the ribs in the ram head also facilitates the ejector moving with respect to the ram without encountering same. Control circuitry having built-in interlocks further ensures against accidents between the ejector and the remainder of the apparatus during the cyclic operation of the apparatus.

Details of the invention now will be described with reference to the accompanying drawings wherein.

The general organization of components forming the baling apparatus corresponds substantially to that disclosed in U.S. Pat. No. 3,824,758. However, FIGS. 1–4 illustrate structural differences between the present invention and the previously patented apparatus.

Figure 1:
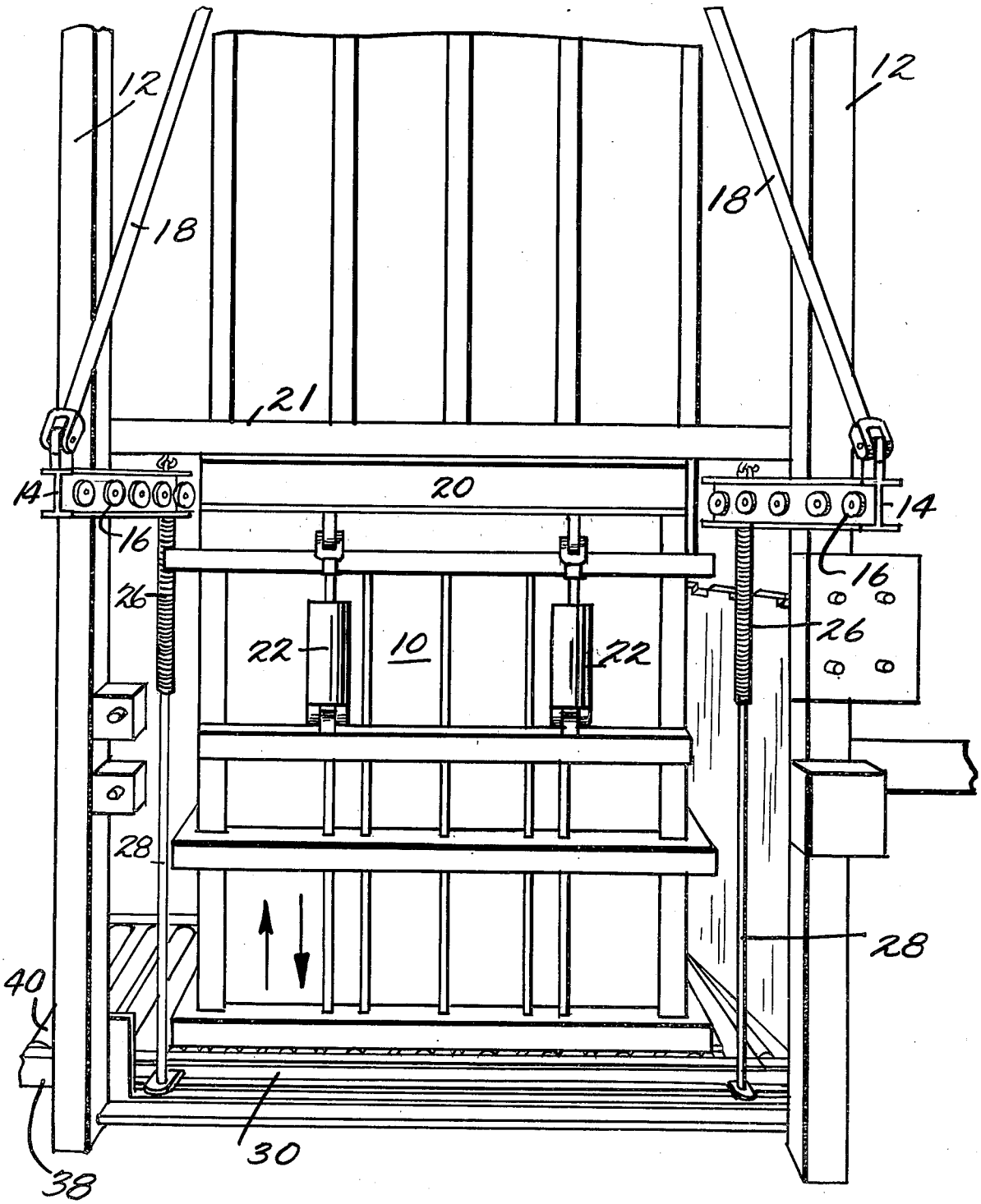
FIG. 1 is a front view of the bottom portion of the baler.
Figure 2:
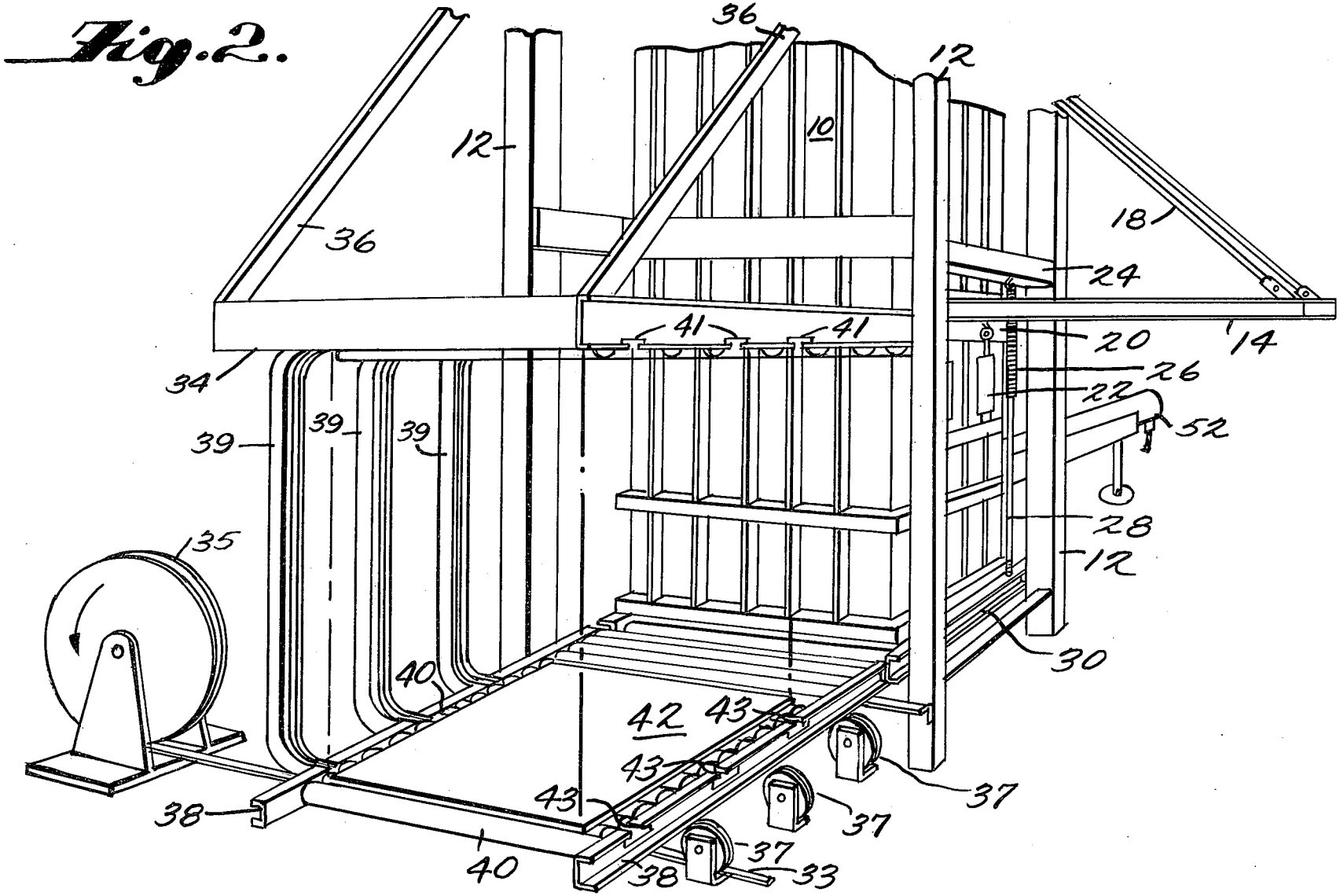
FIG. 2 is a front perspective view of the bottom portion of the baler and of the strapping station with the charging chamber in the fully down position.

Referring to FIGS. 1 and 2, a vertically movable charging chamber 10 is mounted within a frame which includes vertically extending members 12. These members support a pair of I-beams 14 which project outwardly from chamber 10. Each of these beams in turn supports a plurality of rollers 16. The outer ends of the beams 14 are held by rods 18 which are secured to the frame such that the beams are slightly inclined upwardly from their ends towards the chamber. A door 20 is provided in the front wall of chamber 10 proximate the inner ends of the beams 14. The door 20 is opened and closed by air-operated piston devices 22. When the door is open, a bale board can be inserted within the chamber by sliding the board along rollers 16 and allowing it to drop into the chamber 10. The inclined rollers permit the board to properly settle into position within the chamber.

Figure 4:
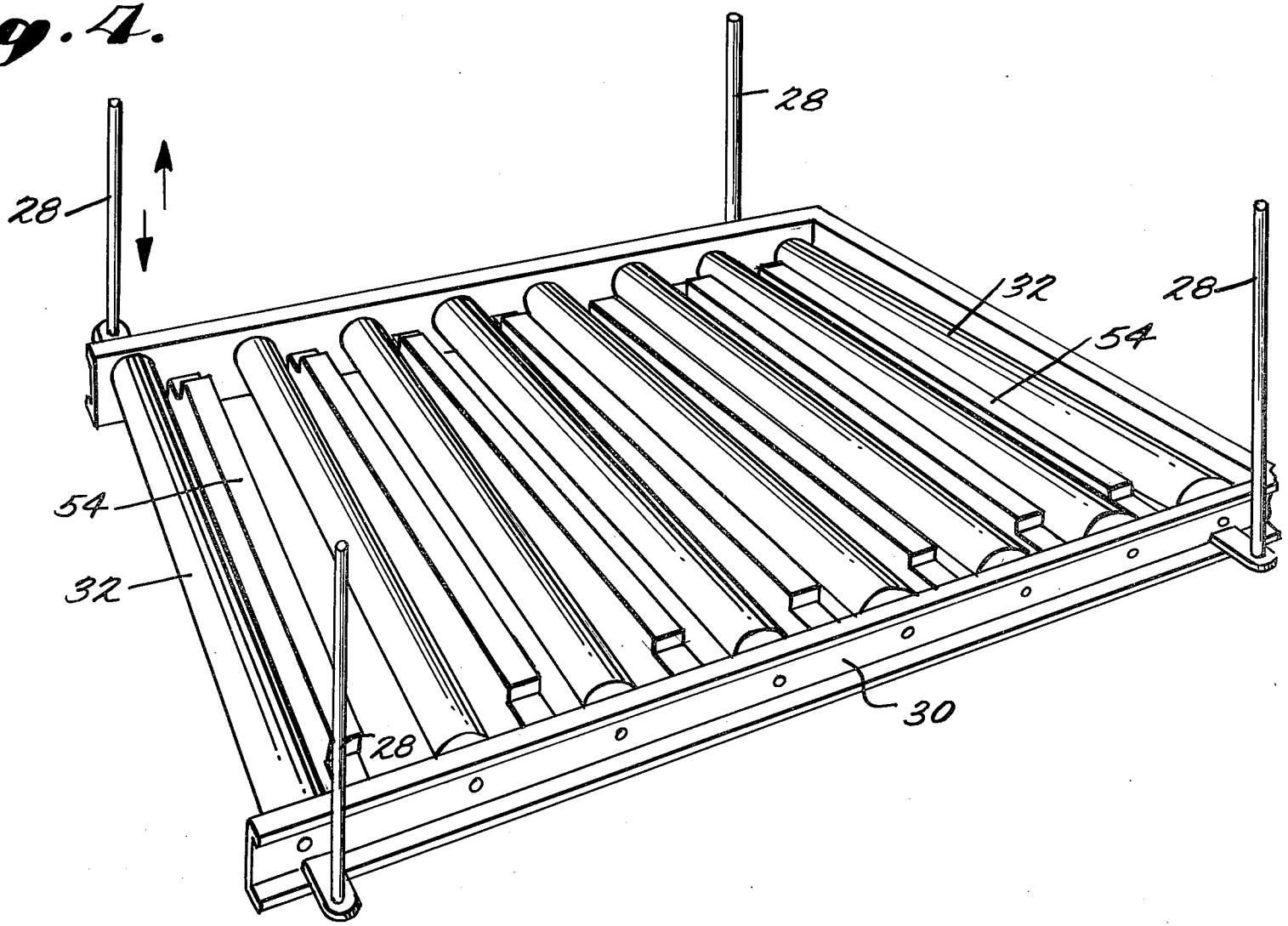
FIG. 4 is a perspective view illustrating the details of the support arrangement for the bottom bale board.

A crossbar 24 extends between the frame members 12. Suspended from the crossbar by springs 26 and rods 28 is a rectangular frame 30 which supports a plurality of spaced rollers 32 (FIG. 4). When the chamber 20 is in its down position, it engages the frame 30 to depress it against the force exerted by springs 26 for purposes to be hereinafter explained.

A complementary roller arrangement extends laterally of the baler. More particularly, a frame 34 is suspended from the baler frame by arms 36. Frame 34 supports a plurality of parallel rollers. Additionally, beams 38 project from the baler adjacent the location of frame 30 so support additional rollers 40 arranged in parallel with those supported by frame 34. The distance between rollers 40 and those supported by frame 34 substantially corresponds to the height of the bale formed by the baler. These free-wheeling rollers serve to hold the height dimension of the bale until it is strapped at the station indicated by the bottom bale board 42 and the dash lines thereabove (FIG. 2).

Prior to the arrival of a bale at the strapping station, the operator draws lengths of strapping material 33 from separate reels 35 (only one such supply arrangement being shown for convenience of illustration) beneath beams 38 and past respective pulleys 37. The operator then threads the free ends of the strapping through conventional C-shaped guides 39 which are mounted in cooperative relationship with openings 41 and 43, respectively, in frame 34 and beams 38. Upon the arrival of the bale at the strapping station, the free ends of the strapping are secured to the running portions in a conventional manner, and during this operation, the strapping escapes from the guides 39. The bale is thus held intact by the straps in order to permit the bale to be removed from the strapping station.

Figure 3:
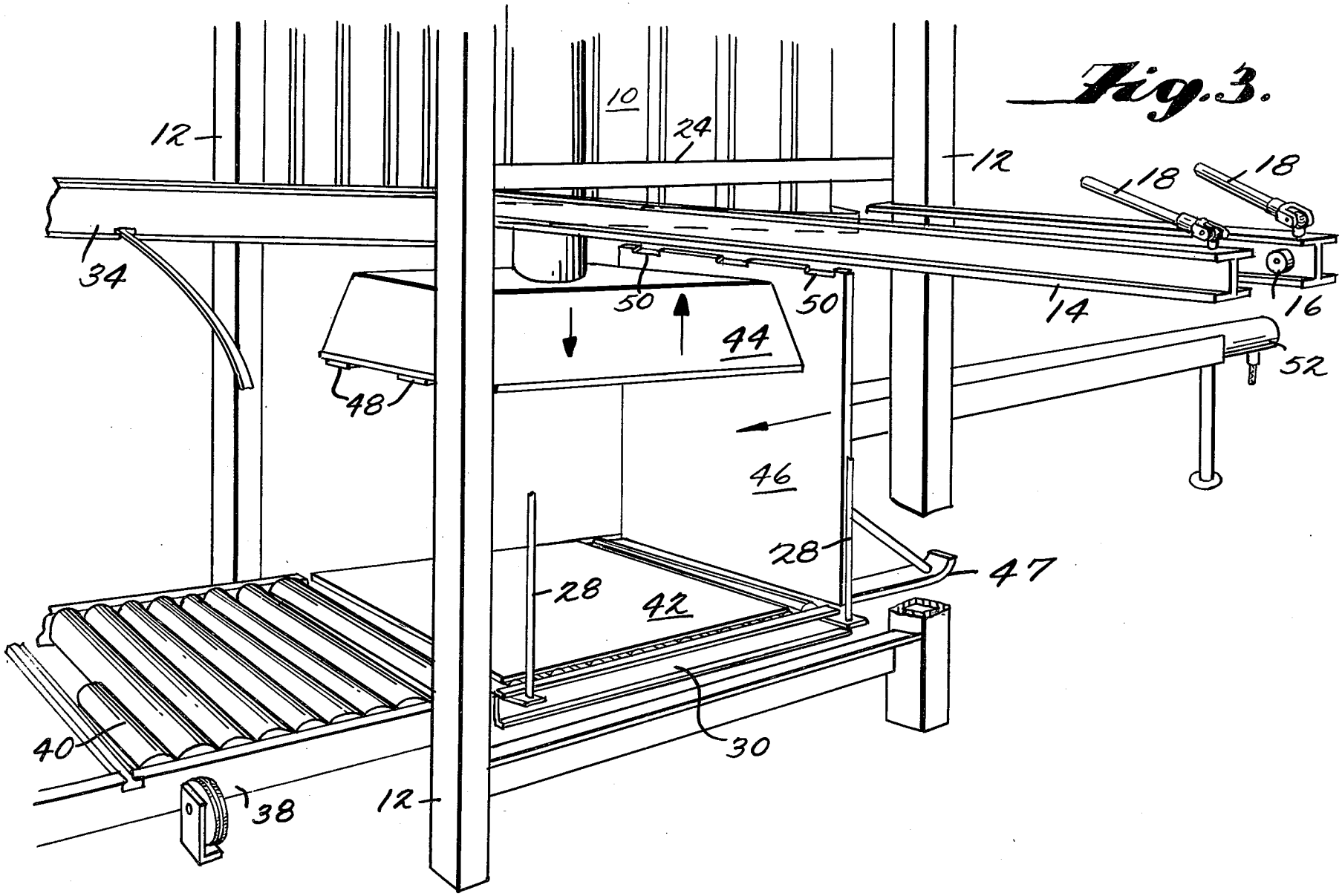
FIG. 3 is a front perspective view of the bottom portion of the baler, and of the ejector and the strapping station, with the charging number in an elevated position.

FIG. 3 is included to show the operative relationship between the ram 44 for compressing the baled material and the ejector plate 46 which moves the bale from the baling station to the strapping station on rollers 40. For convenience of illustration, several of the elements illustrated in FIGS. 1 and 2 have been omitted, and the ram is shown in a position lower than it would be for the ejection operation. The ram includes on its bottom surfaces a plurality of spaced parallel ribs 48 which extend in the direction of movement of the bale as it is displaced by ejector plate 46. The ribs are dimensioned small enough so as to allow the top board to be sufficiently supported by the major undersurface of ram 44 should the board deform during the substantial compression developed as the bale is being formed yet large enough to preclude contact with the major undersurface during ejection. The ribs are tapered at the end nearest the ejector plate 46 in order to provide a sliding surface for the plate in the unlikely event that there is some overlap between the plate and the ribs as the plate 46 starts the ejection operation. The plate 46 includes along its top surface spaced notches 50 which are positioned to receive ribs 48. Plate 46 is arranged for reciprocating movement under the control of conventional means such as a hydraulically operated piston. The actuating apparatus for plate 46 is generally indicated at 52. In operation, after a bale has been formed and is retained between ribs 48 of the ram and the rollers 32 supported by the frame 30, the ejector plate is moved to engage the edges of a bottom bale board 42, a top bale board (not shown) and the side of the bale to slide the bale along ribs 48 and rollers 32 to the strapping station on rollers 40, and the ejector is then returned to the position shown to await completion of the next bale. Inasmuch as the top bale board engages only the relatively limited area formed by the ribs 48 which extend in the direction of the bale movement, only a modest amount of frictional resistance to such movement is encountered by the top bale board. This is not only facilitates displacement of the bale, but it obviates the use of a ram stabilizing device to prevent the ram from being laterally moved.

In order to prevent the bottom of the ejector plate 46 from dropping into the spaces between rollers 32 during the ejection operation, the plate is provided with skids 47 on the rear surface thereof. Two such skids are provided, the skids being positioned on opposite sides of the plate.

The support arrangement for the bottom bale board, similar to that used in the past to support hogsheads as they are filled with tobacco, is illustrated in detail in FIG. 4 wherein the spaced rollers 32 supported by frame 30 are positioned on opposite sides of a plurality of bars 54. These bars are mounted in stationary position having no contact with frame 30 or the rollers 32. When the chamber 10 is in an elevated position out of contact with frame 30, the springs 26 (FIG. 1) maintain the frame so that the upper level of the rollers 32 is at, or above, the upper level of bars 54. However, with the chamber in its lowered position, the frame 30 is depressed so that the upper level of bars 54 is above that of the rollers. Thus, the bale board 42 is completely supported by the bars 54 during compression, while during the ejection operation the board is substantially supported by rollers 32. Such roller support reduces the amount of resistance which the bottom bale board encounters as it moves with the bale to the strapping station.

Since both the top and bottom boards are exposed to limited resistance to movement, only a modest amount of force by the ejector plate 46, limited by a hydraulic relief valve (not shown), is required to displace the bale. Thus, in the unlikely event that the ram 44 is in the path of movement of plate 46, the risk of substantial damage to the operating elements of the baling arrangement is considerably reduced.

Before describing in detail the operation of the baling apparatus according to the present invention, a brief summary will be presented.

Initially, the charging chamber 10 is in the fully down position with its door 20 open, and the ram 44 is withdrawn to the limit of its upward vertical travel. The operator inserts a bottom bale board 42 through door 20 into the interior of the chamber 10. The board drops to its rest position on bars 54, the rollers 32 having been depressed below the level of the bars as a result of chamber 10 being fully down. The operator then commences a first cycle of operation wherein chamber door 20 closes and a conveyor (not shown) carries material to be baled to the interior of chamber 10 where the material is deposited on top of board 42. When the chamber is fully charged, the operator commences a second cycle of operation which includes the following sequence of events:

a. termination of movement of the conveyor and start of downward movement of ram 44 at high speed;

b. at a particular point in the movement of the rams its speed is reduced and it continues to descend at a slow rate for a predetermined timed interval to compress the material being baled (a slow rate of speed being employed to permit accuracy in controlling the distance of travel of the ram);

c. after the prescribed period of time, the direction of movement of the ram reverses and the ram moves upwardly;

d. at a position just above door 20, the ram stops and the door opens to permit the operator to insert a bale board on top of the compressed material.

When the top bale board is inserted, the operator commences a third cycle of operation which includes the following sequence:

a. the chamber door 20 is closed and ram 44 descends at a slow speed;

b. after a prescribed period of time, the ram stops at the final packing height of the bale;

c. the charging chamber 10 then moves vertically to a position clear of the bale;

d. the ejector plate 46 moves the bale to the strapping station;

e. the ejector plate and the ram 44 return to their fully withdrawn locations;

f. the charging chamber 10 descends to its fully down position; and g. the chamber door 20 opens. Time delays are used during the second and third cycles for the important reason that they are easily adjustable to compensate for varying characteristics of the material being compressed. For example, in the case of tobacco, the compressibility and spring-back of the material differ in accordance with type and grade of the tobacco, humidity, etc. By employing time delay devices which can readily be altered in accordance with the characteristics of the material being handled, proper positioning of the ram can be achieved to ensure that the correct bale size is achieved, that the material does not block door 20 to prevent insertion of the top bale board, and the like.

Figure 5:
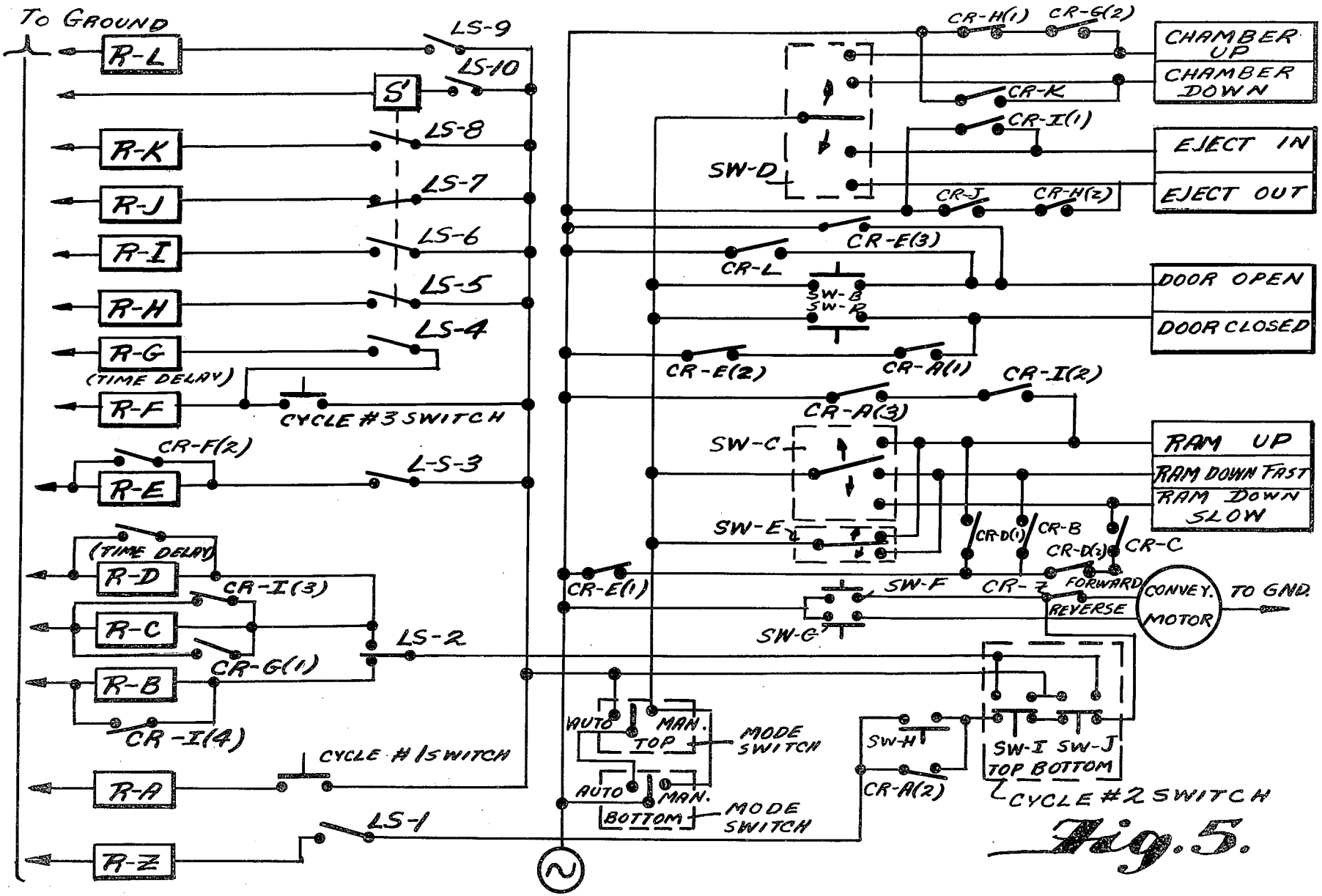
FIG. 5 is a schematic block diagram of a simplified circuit for controlling the operation of the baling apparatus.

The foregoing sequences of operation can be accomplished automatically. To facilitate the understanding of how this may be accomplished, there now will be presented a description of automatic operation which employs the simplified circuitry illustrated in FIG. 5. The description will commence at the point where the operator has inserted the bottom bale board 42 into chamber 10 and is about to commence the first cycle of operation.

DESCRIPTION OF AUTOMATIC OPERATION

At initial conditions with the ram in the fully up position, limit switch LS-1 is closed to energize relay R-Z. As a result, contact CR-Z is closed.

With the top and bottom mode switches in the automatic position, pressing the cycle #1 button causes relay R-A to be energized to close contacts CR-A (1), CR-A (2) and CR-A (3). Closure of CR-A (1) completes a circuit from the power supply through normally closed contact CR-E (2) and through CR-A (1) to the "DOOR CLOSE" actuating system. Closure of CR-A (2) completes a circuit from the power supply through CR-A (2), switches SW-I and SW-J and contact CR-Z to energize the conveyor motor in a forward direction. The conveyor carries the material to be baled to the chamber. When the desired charge has been inserted into the chamber, the process is continued by depression of either of the switches SW-I and SW-J which together form the cycle #2 button. The purpose of contact CR-A (3) will become apparent hereinafter.

Movement of either SW-I or SW-J from the position shown into engagement with its comparison contacts results in the completion of a circuit from the power supply through the mode switches, the cycle #2 switch and limit switch LS-2 to energize relay R-B. This causes contact CR-B to close to complete a path from the power supply, through normally closed contact CR-E (1) and CR-B to the "RAM DOWN FAST" actuating system. Movement of the ram past limit switch LS-1 opens this switch to de-energize relay R-Z thereby opening contact CR-Z. As a result, forward movement of the conveyor motor is prevented while the ram is in any position other than fully up.

As the ram moves downwardly at a fast speed, limit switch LS-2 is engaged to open the circuit to relay R-B and to complete circuits to relay R-C and time delay relay R-D. De-energization of R-B causes contact CR-B to open thereby terminating the fast downward movement of the ram, while the energization of relay R-C closes contact CR-C to complete a path from the power supply, through normally closed contacts CR-E (1) and CR-D (2) and through CR-C to the "RAM DOWN SLOW" actuating system. Thus, the ram continues its downward movement at slow speed.

After a period determined by the setting of time delay relay R-D, its associated normally closed contact CR-D (2) is opened to interrupt the circuit to the "RAM DOWN SLOW" system. Thus, the downward movement of the ram is terminated. Simultaneously, contact CR-D (1) is closed to complete a circuit from the power supply through normally closed contact CR-E (1) and through CR-D (1) to the "RAM UP" actuating system. This causes the ram to move upwardly from its fully down position.

At a position just above the board door opening in the chamber, limit switch LS-3 is engaged to close thereby completing a circuit from the power supply, through the mode switch and L-3 to energize relay R-E. This causes contact CR-E (1) to open terminating the upward movement of the ram, CR-E (2) opens to de-activate the circuit to the "DOOR CLOSE" actuating system, and contact CR-E (3) closes to complete a path from the power supply to the "DOOR OPEN" actuating system. As a result of the latter operation, the door is opened to permit the operator to insert the top board used in forming the bale.

To continue the automatic operation, the cycle #3 button is actuated to complete a path from the power supply through the mode switch and the cycle #3 switch to relay R-F. Energization of this relay causes contacts CR-F (1) and CR-F (2) to close thereby de-energizing relays R-D and R-E. As a result, contacts CR-E (1), CR-E (2) and CR-D (2) are closed, and contacts CR-D (1) and CR-E (3) are opened. Since relay R-A continues to be energized, its contact CR-A (1) remains closed, and power is supplied to the "DOOR CLOSE" mechanism to shut the door in the chamber. Also, relay R-C remains energized causing contact CR-C to be closed thereby permitting power to be supplied to the "RAM DOWN SLOW" actuating system.

As the ram moves downwardly at slow speed, limit switch LS-3 opens and limit switch LS-4 is engaged to close thereby completing a circuit from the power supply, through the mode switch, the cycle #3 switch and LS-4 to energize time delay relay R-G. After a predetermined time established by this relay, its associated contact CR-G (1) closes to de-energize relay R-C. As a result, contact CR-C opens to terminate the downward movement of the ram. Simultaneously contact CR-G (2) associated with R-G is closed to complete a circuit from the power supply through normally closed contact CR-H (1) and CR-G (2) to the "CHAMBER UP" actuating system. Thus, the chamber is moved upwardly to clear the bale for ejection as now will be described.

On reaching a prescribed position in its upward movement, the chamber closes a limit switch LS-5 to complete a circuit from the power supply, through the mode switch and LS-5 to energize relay R-H. This causes normally closed contact CR-H (1) to open thereby terminating the upward movement of the chamber.

There are two limit switches which determine the range of movement of the ejector for removing the bale from the packing position. These are switches LS-6 and LS-7 which are operatively related (mechanically or electrically) such that operation of one also actuates the other. Consequently when one closes the other opens, and vice-versa. At the time the chamber reaches the upper limit of its movement, LS-6 is open and LS-7 is closed. Thus, a cicuit exists from the power supply through the mode switch and LS-7 to energize relay R-J. As a result, contact CR-J is closed. The energization of relay R-H resulting from the operation of limit switches LS-5 when the chamber is fully up closes contact CR-H (2) completing a path from the power supply through contacts CR-J and CR-H (2) to the "EJECT OUT" actuating system. As a result, the ejector moves into engagement with the bale and displaces it to a position where straps may be secured around the bale to hold it intact.

When the bale is completely displaced from its baling position, the ejector engages and closes limit switch LS-6 to complete a circuit from the power supply, through the mode switch and LS-6 to energize relay R-1. Simultaneously, LS-7 opens to de-energize relay R-J. The result of the latter is that contact CR-J opens to terminate the outward movement of the ejector while the energization of R-I causes contacts CR-I (1), CR-I (2) CR-I (3) and CR-I (4) to close. Closure of CR-I (1) completes a circuit from the power supply to the "EJECT IN" actuating system resulting in the ejector reversing its direction and moving towards its fully "in" position. Closure of CR-I (2) completes a path from the power supply through the closed contact CR-A (3) to the "RAM UP" actuating system. The functions of the CR-I (3) and CR-I (4) closures now will be described.

As the ram rises, limit switch LS-4 returns to its open condition de-energizing relay R-G. This causes contact CR-G (1) to open. If no other means of controlling the energization of relay R-C were available, the opening of CR-G (1) would result in contact CR-C closing to complete a circuit to the "RAM DOWN SLOW" actuating system. However, the closed circuit CR-I (3) maintains relay R-C de-energized to prevent such an occurrence.

Continued upward movement of the ram momentarily closes limit switch LS-3, but since closed contact CR-F (2) maintains relay R-E de-energized, the brief closure of LS-3 has no effect on the operation of the system. As the ram proceeds upwardly still further, limit switch LS-2 is engaged to return to the position shown interrupting the circuits to relays R-C and R-D. If means were not provided to bypass relay R-B, the relay would be energized to close contact CR-B thereby tending to reverse the direction of movement of the ram. However, contact CR-I (4) prevents this from happening.

Upon reaching the fully retracted position of the ram, limit switch LS-1 is closed and by suitable well known means (for example electrically) cycle switches #1 - #3 are returned to the positions shown. As a result, relays R-A, R-B, R-F and R-G are de-energized. This causes the associated contacts to return to the positions shown. The opening of contact CR-A (3) is of particular significance in interrupting the circuit to the "RAM UP" actuating system.

During the upward movement of the ram to its fully withdrawn position, the ejector continues moving towards its fully "in" positon. At a point just prior to its fully retracted position, a limit switch LS-8 is closed to complete a path from the power supply, through the mode switch and LS-8 to energize relay R-K. As a result, contact CR-K closes and a circuit is completed from the power supply throgh CR-K to supply power to the "CHAMBER DOWN" actuating system to start the downward movement of the chamber.

Proceeding downwardly, the chamber movement first causes limit switch LS-5 to open, but this has no effect on the operation other than as partial preparation for a subsequent baling cycle.

Continued movement of the chamber momentarily closeslimit switch LS-9 to complete a circuit from the power supply, through the mode switch and LS-9 to energize relay R-L. This results in the brief closure of contact CR-L to cause energization of the "DOOR OPEN" actuating system thereby opening the chamber door in preparation for the next cycle of operation. Actually, the switch LS-9 closure is redundant since it also occurs during the previously described upward movement of the chamber. However, the redundancy is inconsequential.

While the chamber moves downwardly, the ejector completes its retraction by engaging the limit switch LS-7 causing its closure. As stated previously, LS-7 is operatively associated with LS-6 and thus, the latter is opened when LS-7 closes. The opening of LS-6 de-energizes relay R-I returning contacts CR-I (1) - CR-I (4) to the positions shown. The only effect this has on the on-going operation is to terminate the energization of the "EJECT IN" actuating system thereby stopping the ejector at its fully retracted position.

When the chamber reaches its fully down position, limit switch LS-10 is closed to complete a circuit from the power supply, through the mode switch and LS-10 to energize solenoid S. The solenoid is operatively related to switch LS-8 to cause opening of the switch. This results in contact CR-K opening to de-energize the circuit to the "CHAMBER DOWN" actuating system thereby stopping the downward movement of the chamber. When LS-10 is opened by the raising of the chamber during a subsequent baling operation, the de-energization of solenoid S has no effect on the condition of switch LS-8. The latter remains open until closed by the inward movement of the ejector during said subsequent operation.

The foregoing has been a description of the automatic operation of one circuit arrangement for accomplishing the functions of the present invention. It will be understood that at any time, except during the time delay periods of relays R-D and R-G the system can be switched back and forth between manual and automatic models by appropriate actuation of the top and/or the bottom mode switch. In the manual mode only one of the mode switches needs to be in the manual position. Thereafter, selective actuation of switches SW-A through SW-H can result in a complete baling operation being accomplished. Of course, conventional safeguards (not shown for convenience of illustration) are contemplated to prevent manual operation which would result in either the ram or the chamber descending to engage the ejector, or the ejector striking either the ram or the chamber.

DESCRIPTION OF OPERATION OF A PREFERRED EMBODIMENT OF THE INVENTION

Figure 6A:
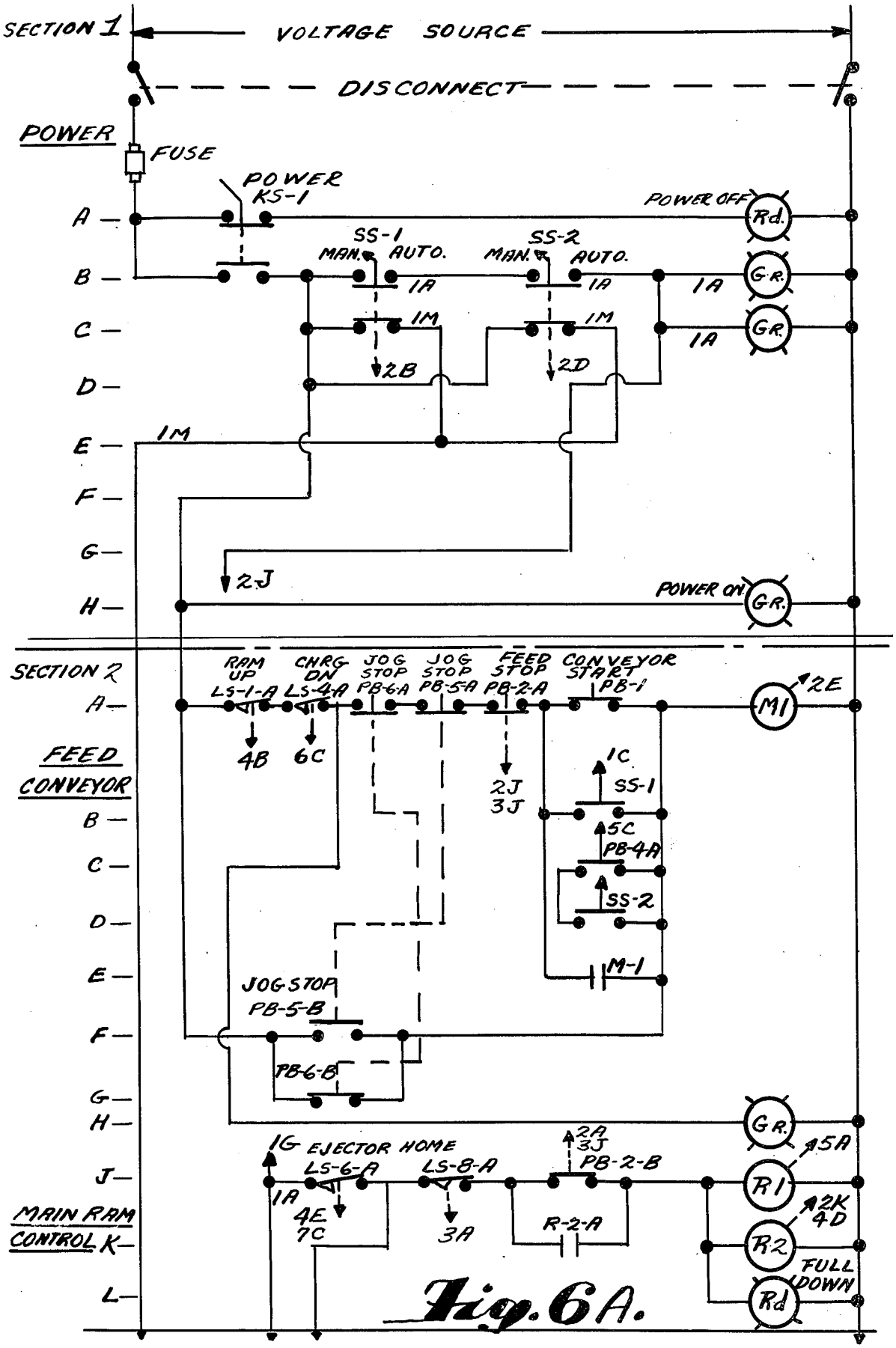
FIGS. 6A, 6B and 6C are schematic diagrams illustrating a preferred circuit arrangement for controlling the baling operation.
Figure 6B:
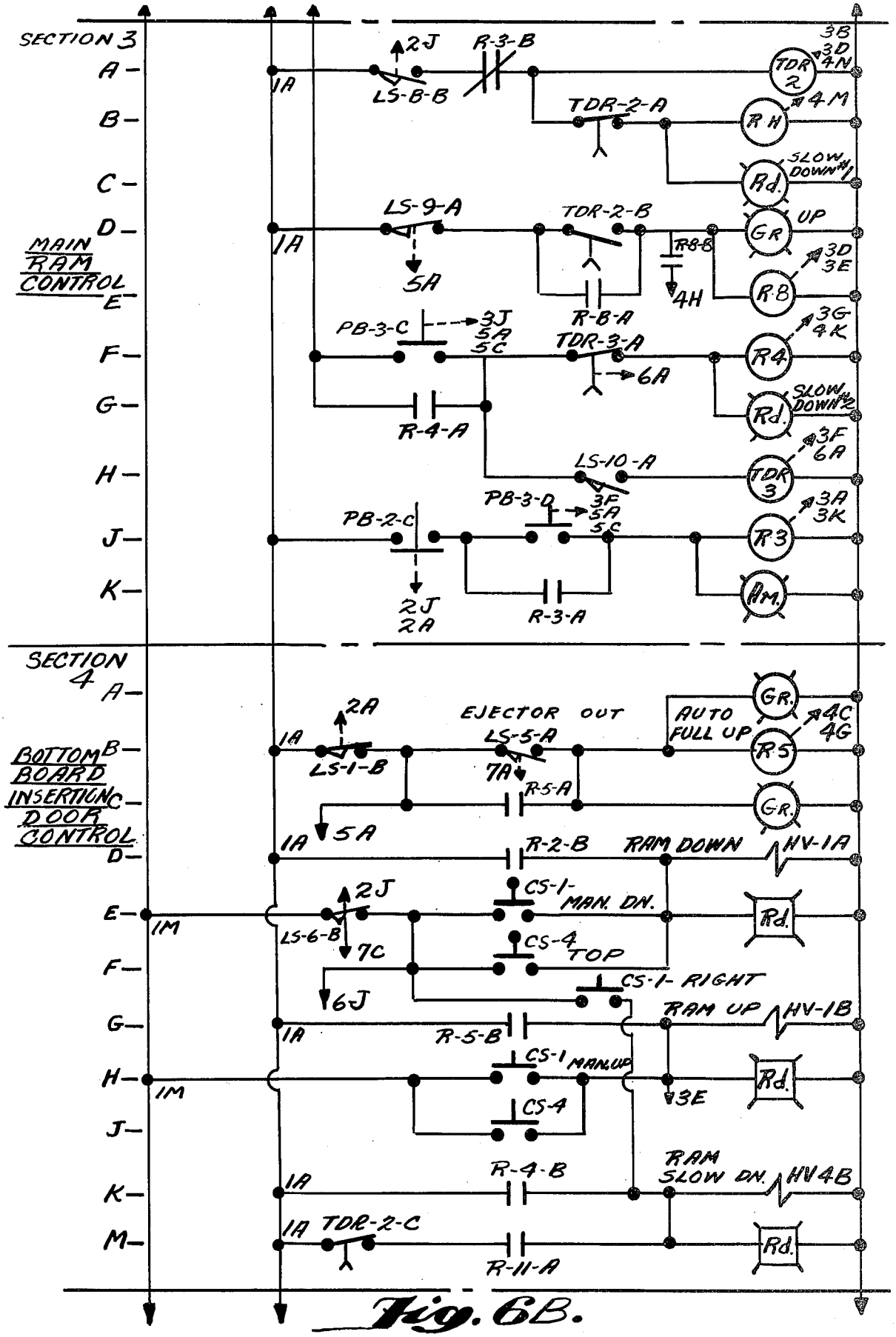
Figure 6C:
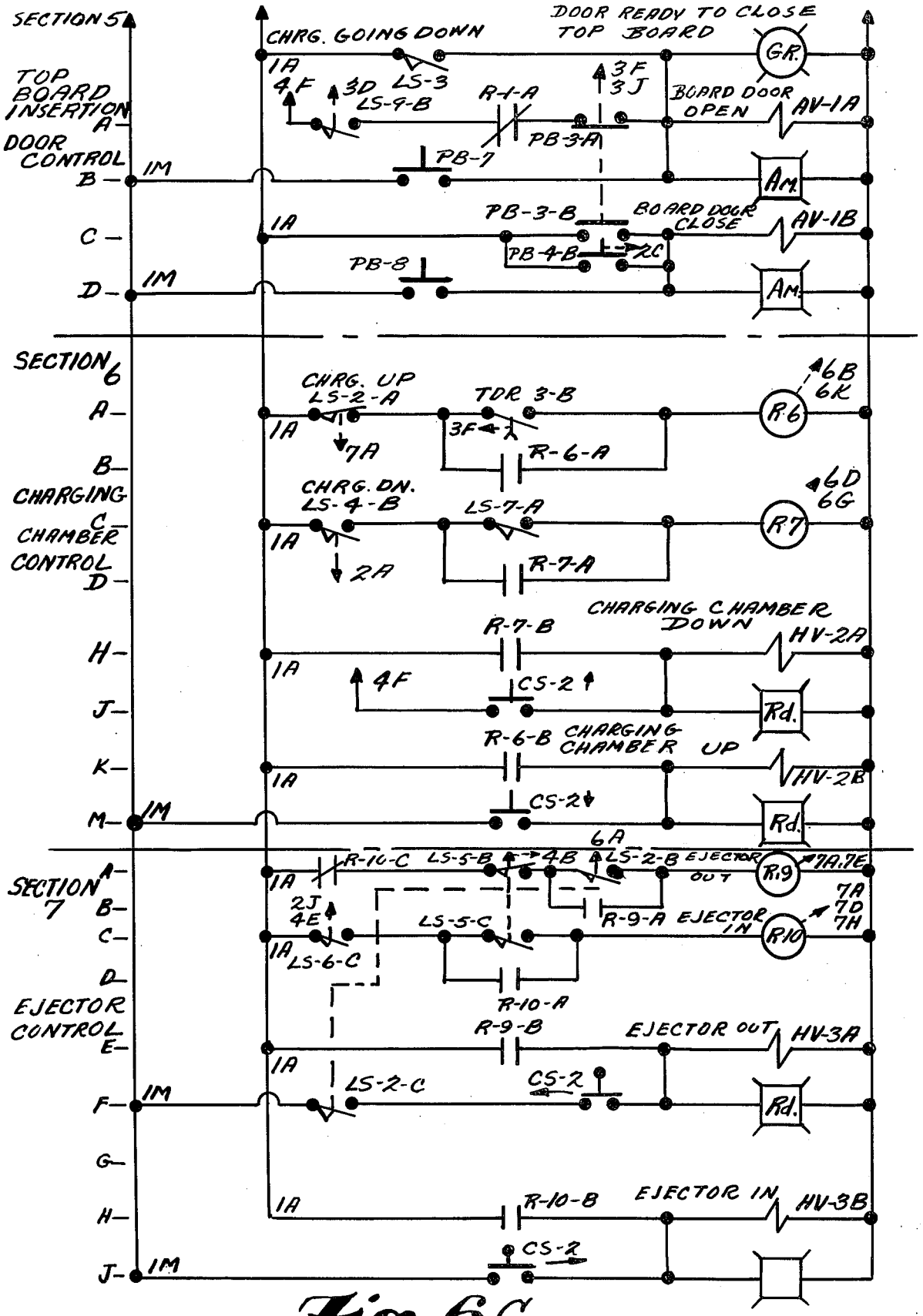

Referrig to FIGS. 6A to 6C, the operation of preferred control circuitry of the present invention will be described.

At initial conditions with the charging chamber 10 empty and in the fully down position and with the main ram 44 in the fully up position, limit switch contracts LS-1-A and LS-4-A are closed and the board door 20 is open. With both the top and bottom mode switches in the Automatic position, the following conditions exist:

1. The closed contacts LS-1-A and LS-4-A permit energization of the feed conveyor latching circuit for operation at the beginning of Cycle #1. These switches preclude the inadvertent filling of the chamber when the main ram is down or the compression chamber is up.

2. Limit switch contact LS-1-B has already performed its function of stopping the upward travel of the main ram during the final phase of Cycle #3, of a preceding operation of the baler. Details of the Cycle #3 operation will be more fully described hereinafter. The open condition of contact LS-1-B also de-energizes the board door open circuitry which at this point is an inconsequential redundancy.

3. Likewise, the opening of contact LS-4-B has already performed its function of stopping the downward travel of the charging chamber during the preceding Cycle #3.

When the operator has inserted the bottom bale board 42 through the board door and it has dropped to the bottom of the charging chamber, he presses a push button having contacts PB-4-A and PB-4-B to start Cycle #1 causing the following to occur:

1. Contact PB-4-B closing energizing the air valve solenoid AV-1B which actuates the board door close mechanism.

2. Contact PB-4-A closes causing a current to flow to the feed conveyor motor relay M-1 which latches "on" because of its contact M-1, provided that an operator has not opened any of the safety stop buttons (PB-2-A, PB-5-A or PB-6-A). Thus the conveyor carries the material to be baled to the chamber.

When the desired charge has been inserted into the chamber, the process is continued by the depression of a push button, which controls contacts PB-2-A to PB-2-C, to starth Cycle #2. Additional convenience switches may be added to start Cycle #2 by arranging additional contacts in series with PB-2-A and in parallel with PB-2-B. Depression of the push button causes the following to occur:

1. Contact PB-2-A opens, de-energizing the feed conveyor relay M-1 causing it to unlatch and the conveyor to stop.

2. Contact PB-2-B closes starting a series of automated operations, provided that the ejector ram is fully retracted out of the path of the main ram to close limit switch contact LS-6-A. With the LS-6-A closed, limit switch contact LS-6-B is closed, permitting downward manual operation of the main ram and charging chamber. Limit switch contact LS-6-C is an inconsequential redundancy at this point. Closed contact LS-6-A also provides current through limit switch contact LS-8-A (which is normally closed and will be described later) to PB-2-B. Thus relays R-1 and R-2 are energized. Relay contact R-2-A latches these relays "on". Relay contact R-1-A opens to prevent inadvertent opening of the board door during this downward operation of the main ram. Relay contact R-2-B closes to energize the ram fast down hydraulic valve solenoid HV1-A, thus starting the downward travel of the main ram.

This action continues until the main ram has descended to a point near the height of the finished bale where a cam (not shown) engages the limit switch controlling contacts LS-8-A and LS-8-B for the duration of the downward travel. Contact LS-8-A opens thus de-energizing relays R-1 and R-2 to stop the fast down operation of the main ram and also closing contact R-1-A for later use in opening the board door. Closure of contact LS-8-B permits energization of TDR-2 and relay R-11, contacts R-3-B and TOR-2-4 being normally closed. Relay contact R-11-A closes and through the normally closed contact TDR-2-C energizes the main ram slow down hydraulic valve solenoid HV4-B.

This action continues for the preset duration of TDR2 at the end of which time relay contact TDR-2-A opens de-energizing relay R-11 to open contact R-11A and thus stopping the slow down operation. At the same time relay contact TDR-2-B closes. Limit switch contact LS-9-A being normally closed, relay R-8 is energized and is latched "on" by closure of its contact R-8-A. Simultaneously, closure of relay contact R-8-B causes energization of the main ram up hydraulic valve solenoid HV-1B.

This action continues until the main ram rises to a point just above the top of the board door opening where it engages the limit switch operating contacts LS-9-A and LS-9-B. Contact LS-9-A open de-energizing R-8 thus stopping the ram up operation. Contact LS-9-B closes to energize the board door open air valve solenoid AV-1A and this terminates Cycle #2 with the chamber ready to receive the top bale board.

When the operator has inserted the top bale board, he actuates a push button controlling contacts PB-3-A to Pb-3-D, thus starting automated Cycle #3. Contact PB-3-A opens, de-energizing the board door open solenoid AV-1A. By the time that the push button is released, the main ram will have started down, as will be described below. This downward movement returns contact LS-9-B to its normally open operating position insuring continued de-energization of the board door open circuit. Closure of contact PB-3-B energizes the board door close air valve solenoid AV-1-B, thus closing the door. Contact PB-3-C also closes energizing relay R-4 via contact TDR-3-A which is normally closed, and the relay is latched "on" by closure of its contact R-4-A. The additional contact R-4-B also closes to energize the main ram slow down hydraulic valve solenoid HV-4-B, thus causing the ram to descend slowly.

This action continues until the main ram descends to a point several inches above the final packed bale height, where a cam engages limit switch LS-10-A for the duration of its downward travel. Closure of contact LS-10-A energizes time delay relay TDR-3. As pointed out above, contact TDR-3-A is normally closed and relay R-4 is latched "on" by its contact R-4-A. At the end of the present time delay, when the main ram is located at the final packed bale height, contact TDR-3-A opens thus de-energizing relay R-4. The main ram slow down circuit is thus de-energized by the opening of contact R-4-B. Contact TDR-3-B closes to energize relay R-6 which latches "on" by its contact R-6-A, contact LS-2-A being normally closed with the charging chamber down. Contact R-6-B closes to energize the charging chamber up hydraulic valve solenoid HV-2-B. As the charging chamber rises contact LS-4-A opens, preventing the feed conveyor relay M-1 from latching "on", and contact LS-4-B closes to permit subsequent lowering of the charging chamber.

This action continues until the charging chamber opens limit switch contact LS-2-A at the chamber's full up position thus de-energizing relay R-6. Consequently, latching contact R-6-A and contact R-6-B open, stopping the charging chamber up operation. Limit switch contact LS-2-C closes to serve as a safety interlock for the ejector during manual operation. Closure of contact LS-2-B permits energization of relay R-9 which latches "on" via its contact R-9-A, contacts R-10C and LS-5-B being in their normally closed positions. Contact R-9-B closes thus energizing the ejector out hydraulic valve solenoid HV-3A. As the ejector 46 starts out, limit switch contact LS-6-A opens, thus preventing automatic downward operation of the main ram while the ejector is extended in its path of travel. Limit switch contact LS-6-B opens preventing manual down operation of both the main ram and the charging chamber. Limit switch contact LS-6-C closes to prepare the Ejector In circuit for operation as described below.

This action continues until the ejector reaches full extension at which point the ejector actuates limit switch contacts LS-5-A to LS-5-C to perform the following functions:

1. Contact LS-5-A closes energizing relay R-5, LS-1-B being in its normally closed position. Contact R-5-A latches this circuit "on" while contact R-5-B energizes the Main Ram Up hydraulic valve solenoid HV-1B. The main ram continues up until it opens limit switch contact LS-1-B thus de-energizing relay R5 and stopping the Ram Up operation. Contact LS-1-A closes to prepare the feed conveyor circuit for repeat of Cycle #1.

2. Contact LS-5-B opens de-energizing relay R9, thus opening its latching contact R-9-A and contact R-9-B, and stopping the Ejector Out operation. 3. Contact LS-5-C closes energizing relay R10, LS-6-C being normally closed. Closure of contact R-10-A latches R-10 "on" while contact R-10-B energizes the Ejector In hydraulic valve solenoid HV-3B. Contact R-10-C opens to keep the Ejector Out circuit de-energized when the ejector retracts to close limit switch LS-5-B.

This action continues until the ejector plate 46 is approximately 3" from being fully retracted where it closes limit switch LS-7-A to energize relay R7 closing its latching contact R-7-A and contact R-7-B, the latter permitting energization of the charting chamber Down hydraulic valve solenoid HV-2A. The chamber continues down until it reaches its fully down position where it opens limit switch contact LS-4-B thus de-energizing relay R7 and stopping the charging Chamber Down operation. Contact LS-4-A closes in preparation for the repeat of Cycle #1.

As the charging chamber comes down, limit switch contact LS-2-A closes and contacts LS-2-B and LS-2-C open. The chamber also momentarily activates limit switch LS-3 energizing the board door open air valve solenoid AV-1A opening the board door in preparation for inserting the bottom board for the next bale.

As the ejector reaches full retraction, it opens contacts LS-6-C de-energizing relay R10. Thus, latching contact R-10-A and contact R-10-B open, stopping the Ejector IN operation. Contact R-10-C also closes preparing the Ejector OUT system for its next operation. Contact LS-6-B closes again to permit manual operation of the main ram now that the ejector is clear of its path. Contact LS-6-A closes in preparation for operation of Cycle #2.

While the foregoing is a description of the automatic operation of the baler, it will be appreciated that manual operation of each of the operative steps of the three cycles can be achieved by means of suitable actuation of the selector switches, SS-1 and SS-2, control switches CS-1, CS-2, etc. The latter switches may take the form of multiposition "wobble" switches, as indicated in FIGS. 6A to 6C.

The description presented above is that of a preferred embodiment of the invention. However, alternative arrangements and features are possible. For example, while the baler which has been described produces bales of a given height, it will be understood that by adjusting the spacing between the frame 34 and beams 38, by varying the size of ejector plate 46 (e.g., by forming the plate with removable sections), etc., bales of different height can be formed. Such a feature is particularly useful when the requirements for different methods of shipping vary.

What is claimed is:

1. Apparatus for baling a compressible material between bottom and top bale boards comprising:

means for supporting said bottom board, said supporting means including a frame and a plurality of spaced parallel rollers mounted in said frame;

a chamber movable between a retracted position and a position at which said supporting means is engaged and said bottom board is enclosed;

a door in said chamber to permit insertion of the bale boards within the chamber;

a ram movable within said chamber, said ram having a material and top board-contacting surface comprising a plurality of spaced parallel ribs extending in a direction perpendicular to the axes of rotation of said rollers;

means for introducing material to be compressed to said chamber when said chamber engages the support means, a bottom board is supported by the support means, and said ram is in a withdrawn position within the chamber;

means for moving said ram from the withdrawn position to compress material introduced into the chamber onto the bottom board;

means for controlling movement of said ram within the chamber for first compressing material, then retracting said ram to a position adjacent the door to allow the top board to be inserted within the chamber between the ram and the compressed material, and then moving the ram in a single direction to engage and displace said top board to a bale forming position at which the material and the boards are formed into a bale having a predetermined dimension;

means for moving said chamber to its retracted position when the bale is formed to said dimension;

ejector means operable when said chamber moves to the retracted position and while said ram is retained in its bale forming position for displacing the bale from said supporting means, in a direction perpendicular to said roller axes, to a location between sets of additional rollers spaced to the dimension of said bale; and means responsive to the position of the ejector means followng displacement of the bale for returning the ram to the withdrawn position and the chamber to the supporting means-engaging position.

2. Apparatus as set forth in claim 1, wherein said ram is initially moved from the withdrawn position at a first speed and wherein said means for controlling the movement of the ram is responsive to the position of the ram during its movement to reduce the ram speed.

3. Apparatus as set forth in claim 2, wherein said controlling means further includes timing means for controlling the period of movement of the ram at reduced speed.

4. Apparatus as set forth in claim 3 wherein said controlling means includes;

means for retracting the ram by reversing the ram movement at the end of the period determined by said timing means; and means for terminating retraction of the ram at said position above the door.

5. Apparatus as set forth in claim 4, further comprising additional timing means responsive to the position of the ram for controlling the period of movement of the ram at reduced speed in forming the bale to the desired dimension.

6. Apparatus as set forth in claim 5 wherein said means for moving the chamber to its retracted position is responsive to said additional timing means.

7. Apparatus as set forth in claim 1, wherein said ejector means includes an ejector plate notched at spaced locations along one edge thereof to receive said parallel ribs.

8. Apparatus for baling a compressible material between bottom and top bale boards comprising:

means for supporting said bottom board;

a chamber movable between a retracted position and a position at which said supporting means is engaged and said bottom board is enclosed;

a ram movable within said chamber means for introducing material to be compressed to said chamber when said chamber engages the support means and said ram is in a withdrawn position within the chamber;

means for moving said ram from the withdrawn position to compress material introduced into the chamber onto the bottom board;

a door in said chamber to permit insertion of the bale boards within the chamber;

means for controlling movement of said ram within the chamber for first compressing material, then retracting said ram to a position above the door to allow the top board to be inserted within the chamber between the ram and the compressed material, and then moving the ram to engage said top board to form a bale, which comprises the material and the boards, to substantially the final desired bale dimension;

means for moving said chamber to its retracted position when the bale is formed to said dimension;

ejector means operable when said chamber moves to the retracted position for displacng the bale from between said supporting means and the ram to a position between sets of rollers spaced to the dimension of said bale, the displacement of said bale being facilitated by the supporting means which includes a frame, a plurality of spaced parallel rollers mounted in said frame with the axes of the rollers extending perpendicular to the direction of displacement of said bale, a plurality of stationary bars extending in a direction parallel to the axes of said rollers and positioned in the spaces between the rollers, and resilient means supporting the frame whereby during compression of the material said rollers are depressed causing said bottom board to rest on said bars and whereby when said bale is formed to the desired dimension the bottom board rests on said rollers; and means responsive to the position of the ejector means following displacement of the bale for returning the ram to the withdrawn position and the chamber to the supporting means-engaging position.

9. Apparatus as set forth in claim 8, wherein said ram has a material and top board-contacting surface having a plurality of spaced parallel ribs extending in the direction of displacement of said bale.

* * * * *